US006749193B2

(12) United States Patent
Berdelle-Hilge et al.

(10) Patent No.: US 6,749,193 B2
(45) Date of Patent: Jun. 15, 2004

(54) DEVICE AND METHOD FOR LOADING THE INPUT UNIT OF A LETTER SORTING SYSTEM

(75) Inventors: Peter Berdelle-Hilge, Constance (DE); Christoph Hofmann, Salem (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 10/375,261

(22) Filed: Feb. 28, 2003

(65) Prior Publication Data

US 2003/0141651 A1 Jul. 31, 2003

Related U.S. Application Data

(63) Continuation of application No. PCT/DE01/03702, filed on Sep. 26, 2001.

(30) Foreign Application Priority Data

Sep. 29, 2000 (DE) ..... 100 48 805

(51) Int. Cl.[7] ..... B65H 1/02

(52) U.S. Cl. ..... 271/149; 271/157; 271/158; 271/162

(58) Field of Search ..... 271/149, 150, 271/157, 158, 162

(56) References Cited

U.S. PATENT DOCUMENTS 3,915,338 A * 10/1975 Kronseder et al. ..... 221/1
4,052,052 A * 10/1977 Muller ..... 271/157
5,044,877 A * 9/1991 Constant et al. ..... 414/798.9
5,213,321 A * 5/1993 Stobb ..... 271/149
5,915,685 A * 6/1999 Bausch et al. ..... 271/157
5,934,666 A * 8/1999 Rabindran et al. ..... 271/148
6,247,694 B1 * 6/2001 Nonnemacher et al. ..... 271/146
6,354,587 B1 * 3/2002 Engarto ..... 271/149
6,511,062 B1 * 1/2003 Blackwell et al. ..... 271/153

* cited by examiner

*Primary Examiner*—David H. Bollinger
(74) *Attorney, Agent, or Firm*—Jacob Eisenberg; Siemens AG

(57) ABSTRACT

The invention relates to a device and a method for loading the input unit of a letter sorting system with letters that are stood on their edges. The device comprises of at least one stack receiving device which is located on a carriage and which can receive a stack of letters at a given location. The device comprise a stack base which can be moved beyond the carriage in the direction of the stack, horizontally, and one or two separating blades which hold the stack. The blades can be displaced along the stack base and can rotate in and out of the stack receiving device. The dimensions and the height of the stack receiving device are configured in such a way that the stack base can be moved onto the letter conveyor line with the separating blade(s) of the stack receiving device and urged to the input unit.

7 Claims, 7 Drawing Sheets

DEVICE AND METHOD FOR LOADING THE INPUT UNIT OF A LETTER SORTING SYSTEM

CONTINUATION DATA

The present invention is a continuation of and claims priority to international application: PCT/DE01/03702, filed Sep. 26, 2001, and further claims priority to German patent application 10048805.6, filed Sep. 29, 2000, both of which are incorporated herein by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to a device and method for loading a feeder of a letter sorting system, the device having a mail singling or isolating device, a horizontally oriented mail conveyor line connected thereto having a supporting wall for the transport of edgewise standing flat mail pieces to the letter sorting system, and a separating knife swiveling in and out and in transport direction for the support and transport of mail pieces to the letter sorting system, traveling and reversing again along linear guides.

Current method of loading the feeder are mainly elaborate and manual. The mail pieces are dumped from a mail container to the mail conveyor line or manually placed stackwise from the mail container and placed on the mail conveyor line. Next, they are manually moved to the mail singling device. Here, the remaining stack is orientated on its lower edge and laterally stands against the supporting wall. The separating knife is then swiveled in behind the stack and the mail singling device starts. The separating knife and in addition, the optional mail conveyor line designed as driven conveying belt coupled with the separating knife, control feeds the stack under a select stack-pressure to the mail singling device.

A device for the automatic loading of the feeder of a letter sorting system (EP 0 865 328 B1) is known where the direct loading process takes place without manual operations. A loaded container is thereby emptied by a loading module onto the mail conveyor line of the feeder between two additional, traveling and swiveling separating knives. The stack is then automatically shifted in a direction of the mail singling devic to the remaining stack, by the two separating knives, the separating knife supporting the remaining stack swivels out, advances closely behind the rear additional separating knife, swivels in again and the two additional separating knives swivel out and advance to the back for the acceptance of a new stack. With this solution, the mail pieces get to the feeder in a mail container, i.e. the mail pieces have to be loaded into the mail containers relatively elaborately. In many cases these mail pieces arrive from preliminary sorting machines. The pre-sorted mail pieces are then loaded from the respective sorting bins into the mail container and, as described, transported to the respective feeder.

There are also sorting processes with several successive sorting runs, where the mail pieces are not loaded from the sorting bins into the mail containers, but moved over a transfer bridge from the sorting bins on the mail conveyor line of the feeder (DE 42 36 507 C1). A certain machine-layout is necessary for this, where the sorting bins and the mail conveyor line of the feeder are opposed.

SUMMARY OF THE INVENTION

The present invention is based on the task of creating a device and method for loading the feeder of a letter sorting system with edgewise standing flat mail pieces, with which support the loading of the mail pieces from preliminary letter sorting systems into mail containers is no longer necessary or no requirements regarding the spatial arrangement of feeder and sorting bins are necessary for machine-layouts with sorting processes of several sorting runs, whereby the respective sorted mail pieces of the feeder are directly fed again without the mail container.

By using at least one stack receiver located on a chassis, which is loadable at any location and upon which base the mail stack is traveling beyond the chassis horizontally in direction stack, whereby the mail stack is supported by one or two separating knives sliding along the stack base, it is possible to avoid the loading of the mail stack into mail containers. The stack receiver is designed like the mail conveyor line with a supporting wall, whereby it is not traveling like the base of the stack. The stack receiver is advanced to the mail conveyor line of the feeder in such a way that it forms a quasi extension. Afterwards, the base of the stack is moved on the mail conveyor line up to its stack knives, for example along telescopic tracks or with the support of wheel or rolls, which run on the mail conveyor line and the new mail stack is moved to the remaining stack located still on the mail conveyor line or, if the mail conveyor line is already empty, to the mail singling device with the separating knife (knives) of the stack receiver. After the swiveling out of the separating knife of the mail conveyor line, advancing behind the stack which is located on the base of the stack, swiveling into the stack receiver and swiveling out of the separating knife (knives) of the stack receiver, there is a uniform mail stack in front of the mail singling device. The base of the stack is now withdrawn under the mail pieces and the stack stands directly on the mail conveyor line and can be moved to the mail singling device during the singularization, separation, or isolation (terms to be used interchanably throughout).

For conditions as most uniform as possible during the withdrawal of the mail pieces, the separating knife of the mail conveyor line is advantageously traveling by a traveling device in a direction of the mail singling device. This keeps the measured stack pressure upon the mail singling device at a substantially controlled constant. To gently carry out the transport of the mail pieces, it is advantageous, to realize the mail conveyor line as a conveying belt which moves in sync with a separating knife during the procedure from the mail stack to the mail singling device.

To create the transport of the mail pieces from the stack receiver on the mail line gently for the mail pieces and to prevent a sliding away of the mail pieces standing on a smooth surface during the loading of the stack receiver, the base of the stack receiver is advantageously designed as a conveying belt with a rough surface moveable only in the direction of the mail singling device.

If the mail pieces are stacked against the front separating knife, in the direction of the mail singling device, they don't slide away because of the rough ground and the blocked reversing motions of the conveying belt. On the other hand, the mail pieces are not moved over the rough ground during the unloading on the mail conveyor line, because the loaded ground surface remains quasi locally immobile during the withdrawal of the moveable part of the stack receiver.

It is also advantageous to advance the stack receiver(s) to the sorting bins of any letter sorting system and to load it from the sorting bins. These are advantageously the sorting bins of the letter sorting system at a sorting process with several sorting runs, which feeder has to be loaded several times.

The present invention further relates to a device for loading of a feeder of a letter sorting system, comprising: a mail singling device, a horizontally directed mail conveyor line with a supporting wall for transport of edgewise standing, flat mail pieces to the mail singling device, and a separating knife swiveling in and out of the transport direction for the support and transport of mail pieces to the mail singling device traveling and reversing again along linear guides, wherein at least a stack receiver located on a chassis, picking up the mail stack at any location with a stack base horizontally moveable in stack direction, beyond the chassis, one or two separating knives supporting the stack, moveable along the stack base and swiveling in and out of the stack receiver and an additional supporting wall, whereby the dimensions and the height of the stack receiver are designed in such a way that the stack base is moveable with the separating knife to the stack receiver on the stack conveyor line to the separating knife of the feeder and that in the following, after the separating knife of the feeder has swiveled out, moved and swiveled in again behind the mail stack located on the stack base, and that the separating knives of the stack receiver are swiveled out, the stack base can be withdrawn under the mail pieces from the area of the mail conveyor line and is moveable into the loading position with the separating knives of the stack receiver.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

The mail pieces in the present example are sorted according to the distribution order of letter carriers. Because the letter sorting system possesses only a limited number of sorting bins, this must be carried out in several successive sorting runs, wherein the mail pieces have to be fed again to the feeder in the exact sorted order as from the sorting bins.

The mail pieces are stacked, from back to front, into the sorting bins, where they are protected towards the front by being resiliently pressed against a swiveling pallet. The emptying of the sorting bins and loading of a mobile stack receiver may then easily occur when the mail stack is moved from the sorting bin on the stack receiver. The sequence functionality is facilitated by a multi-staged sorting of the mail pieces for the letter sorting system. The used distribution strategy is based on a two-pass process:

1. The mail pieces are delivered in transport containers and loaded on the feeder of the mail conveyor line and singularized.
2. After completion of the first run, the mail pieces are brought back to the feeder and singularized a second time. The order of the mail pieces per sorting bin must hereby not be changed.
3. After the second pass, the mail pieces are packed into the transport containers again.

After the first run, the mail stacks are loaded from the sorting bins on one or several stack receivers located on chassis which are distributed along the letter sorting system. The individual stack receivers are then advanced to the feeder and unloaded.

Figure 1A:
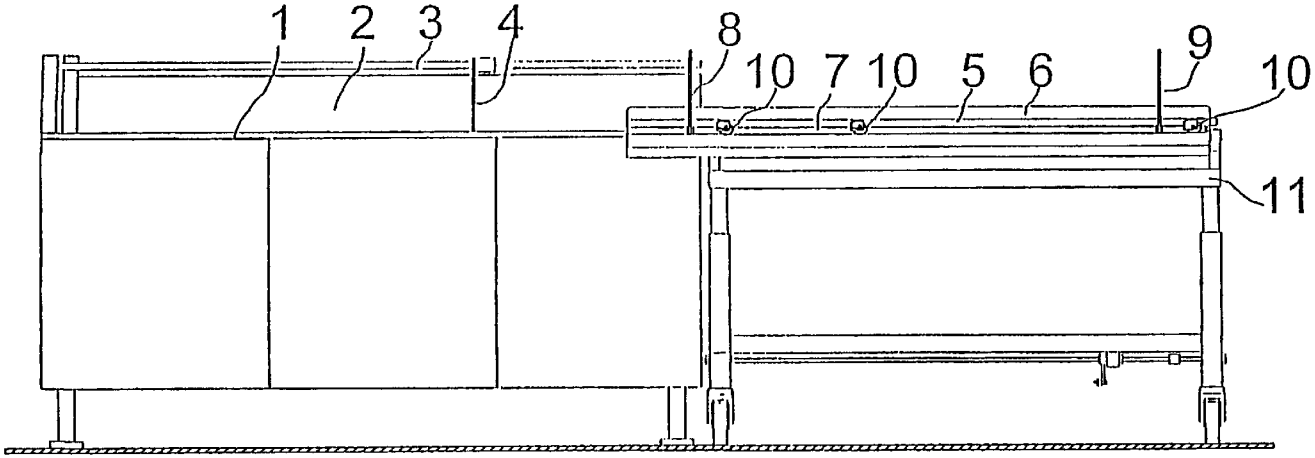
FIG. 1*a* depicts a side view of a loading device at the feeder of a letter sorting system
Figure 1B:
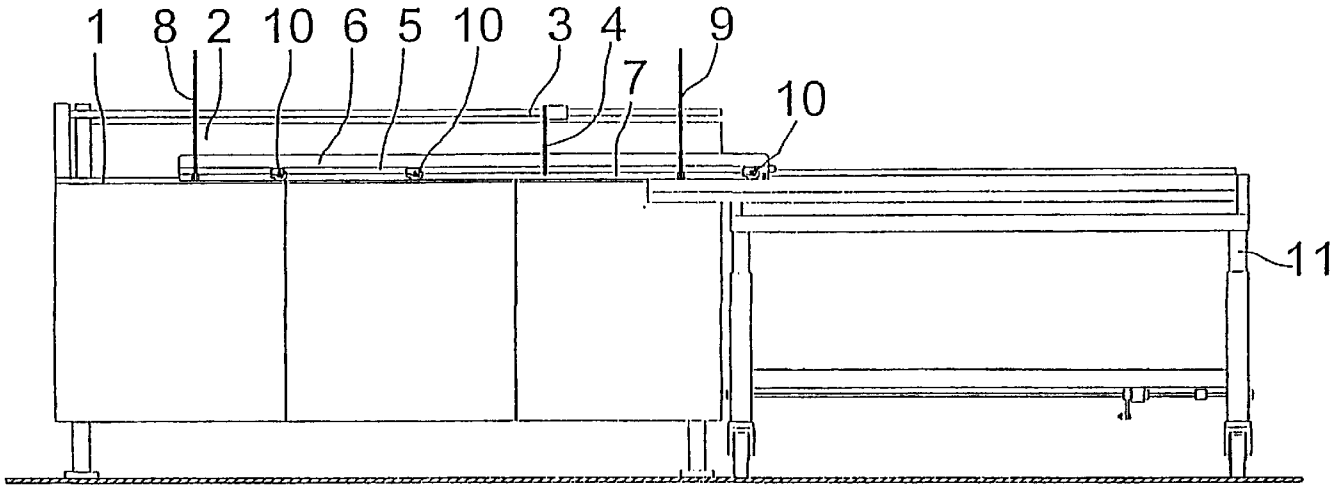
FIG. 1*b* depicts a side view of the loading device
Figure 1C:
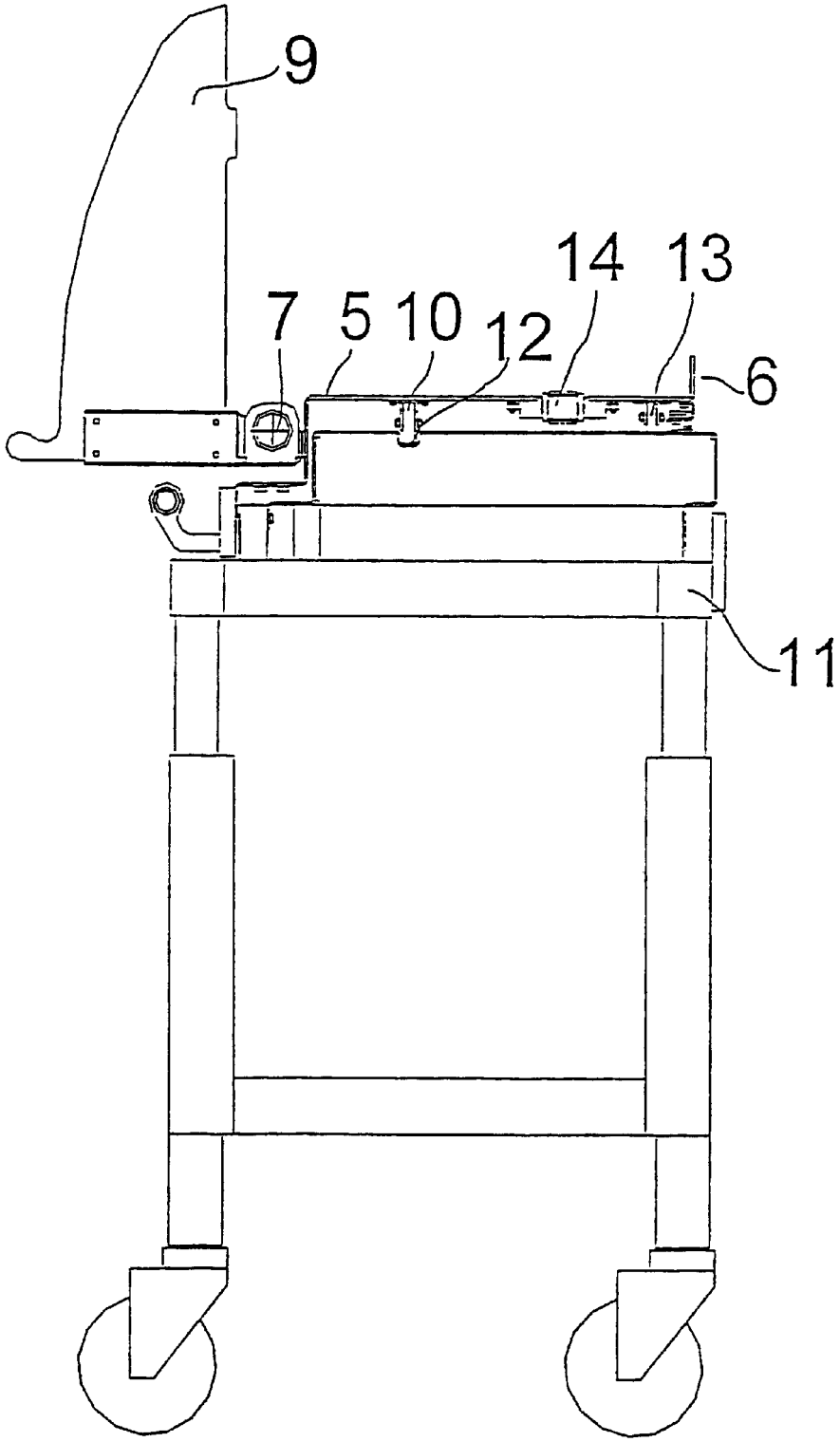
FIG. 1*c* depicts a side view of a loading device in stacking direction.

As can be gathered from FIGS. 1*a*, 1*b*, and 1*c*, the stack receiver is attached on a chassis 11. The receiver possesses a stack base 5 which is extends beyond the chassis, two separating knives or blade 8 and 9 which are moveable along linear track or guide 7 along the stack base 5 and which may be made to swivel in and out of the stack receiver, a supporting wall 6 upon which the upright mail pieces orient themselves. The stack base 5 is a bit higher than the mail conveyor line 1 of the feeder, so that it can be moved on it. The stack base 5 possesses six rollers 10 and 13 with which it runs on the chassis 11 and on the mail conveyor line 1. Two of the rollers 10 and 13 are oriented side by side, such that the roller 10 runs towards the linear guide in a straight, respectively large sparing in the mail conveyor line 1 and a base plate of the chassis 11. The shifting of the stack base is also possible with the assistance of telescopic tracks which also take over the supporting function. The supporting wall 6 of the stack receiver connected to the stack base 5 shows a lower height than the supporting wall of the feeder and is moveable on the mail conveyor line with the stack receiver conterminous to its supporting wall 2. The mail pieces are not disclosed for better overview.

Figure 2A:
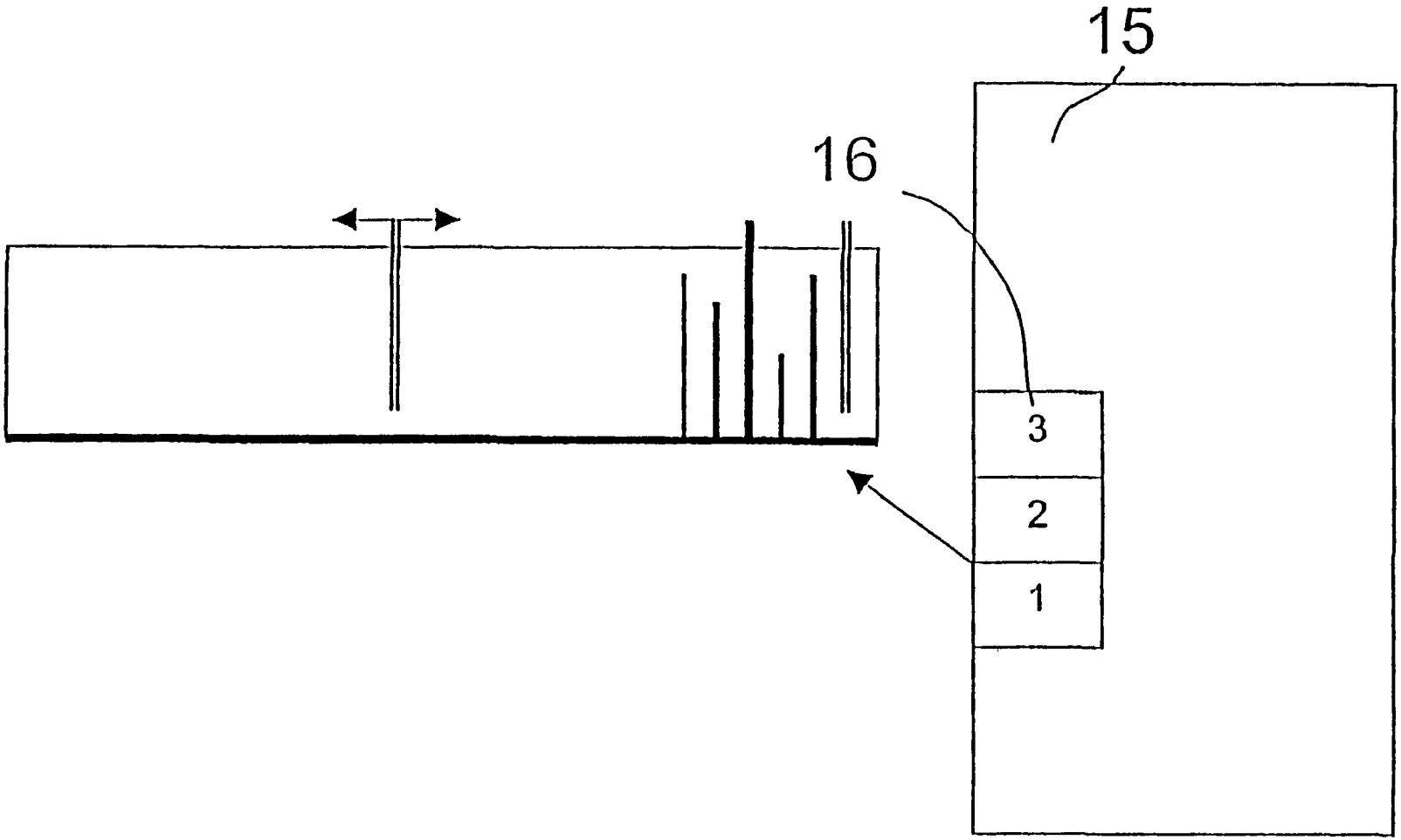
FIGS. 2*a* and 2*b* depict loading of the stack receiver from sorting bins, and FIGS. 3*a,* 3*b* and 3*c* depict top views of the loading process in schematic form.
Figure 2B:
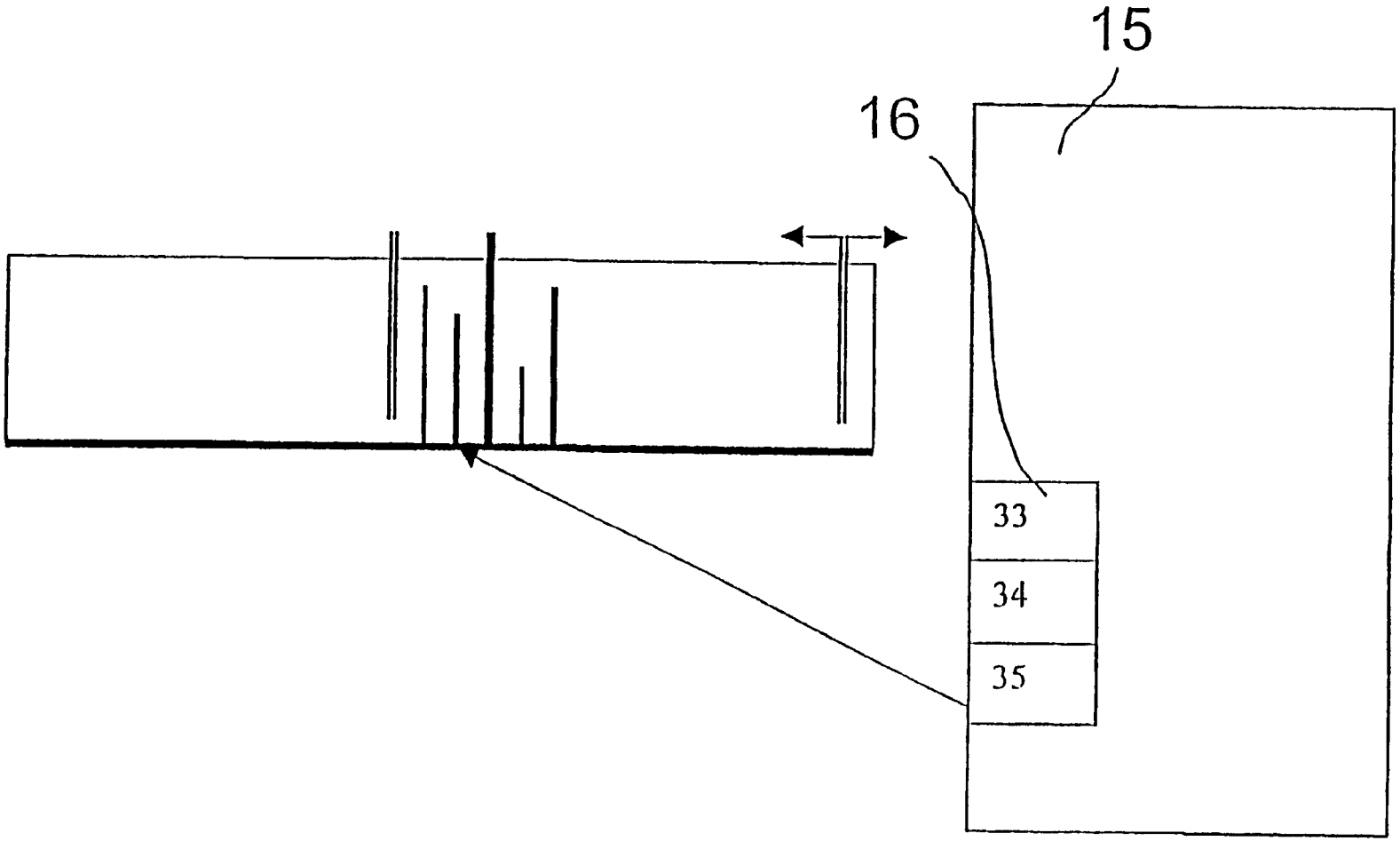
Figure 3A:
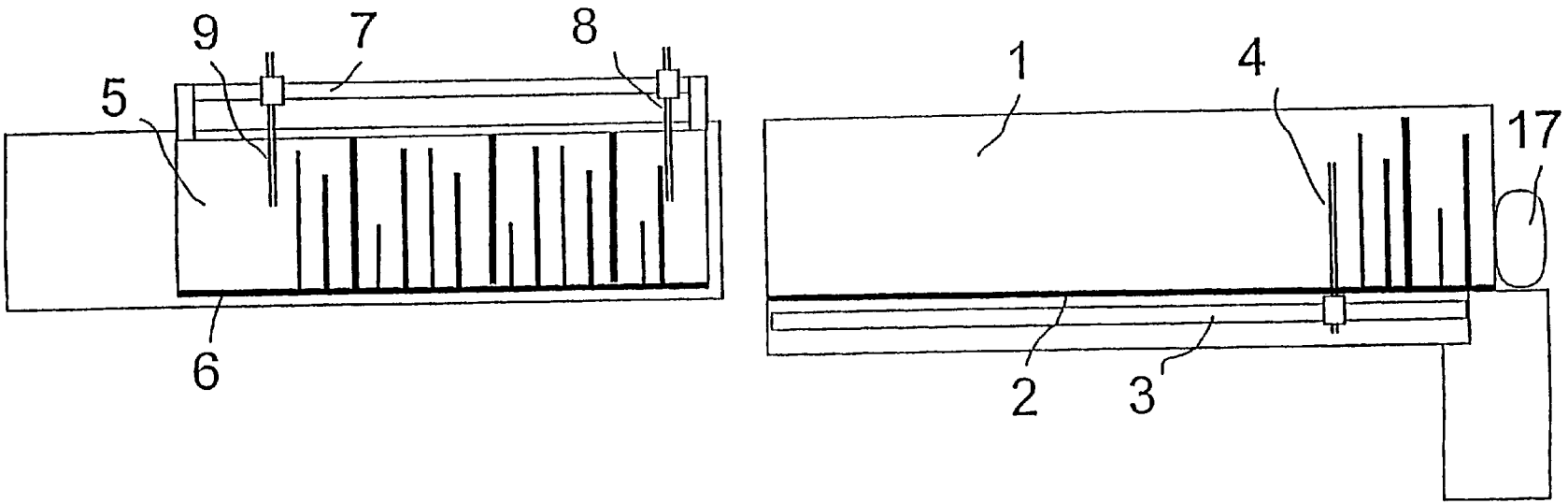
Figure 3B:
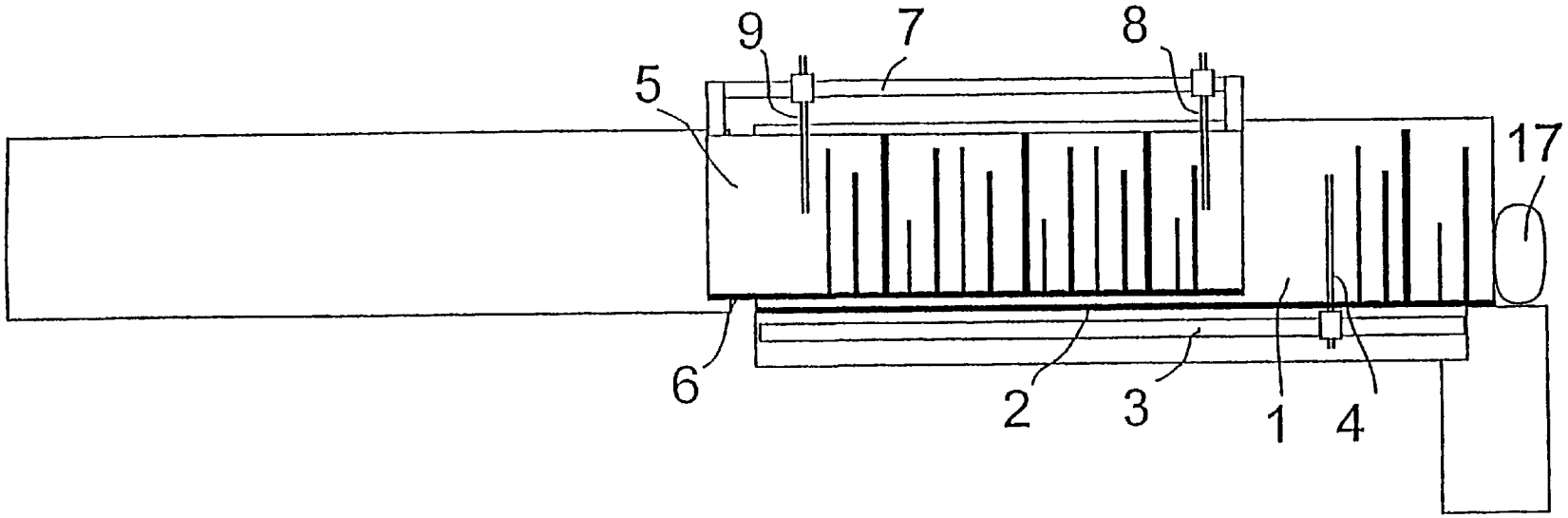
Figure 3C:
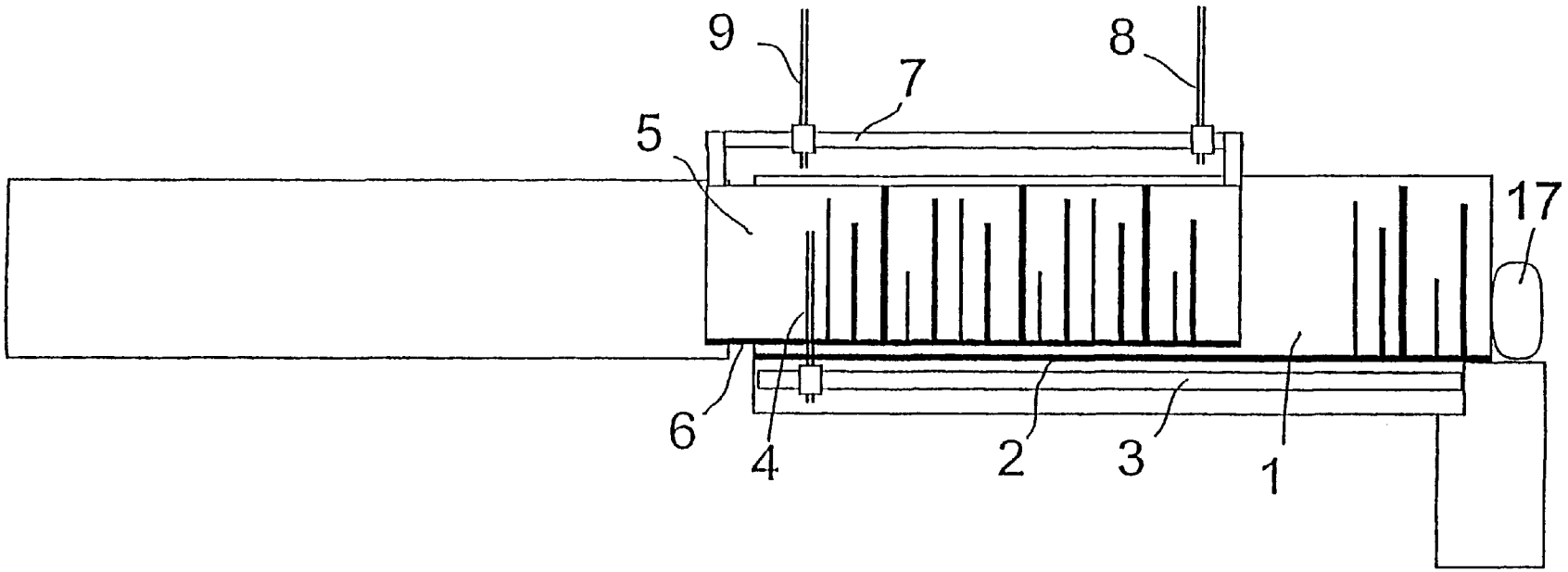

As depicted in FIG. 2*a*, the stack receiver located on the chassis 11 is placed in at an approximately 90° angle to the bin wall 15 with the sorting bins 16 for the loading of the stack receiver in a first version or location. The present method starts with the contents of bin no. 1, which is deposited to the left of the front separating knife 8, and then the content of bin no. 2 which is deposited to its left, and so forth.

The stack can be prevented from turning over to the left by separating knife 9. In practice, the separating knife 9 is only tracked if the deposited stack exceeds a certain slanting position. Three conversions need to be calculated per load at a length of for example 1 m.

The separating knives 8 and 9, moveable from the linear guides 7, can be moved freely along the stack receiver in the swiveled up condition. There is a narrow conveying belt 14 in the smooth stack base 5 as a component of the base with rough, herein cross-wise corrugated, surface, which is moveable only towards mail singling device 17. If the mail pieces are leaned against the front swiveled in separating knife 8 during the stacking on the stack base, a sliding away of the mail pieces is then thereby prevented. After completion of this stacking process, the rear separating knife 9 is also swiveled in. Both separating knives 8 and 9 are therefore, so to speak, interlocked into the cross-wise corrugated conveying belt 14 and support the mail stack safely.

Afterwards, the shifting of the stack base 5 with the mail stack onto the mail conveyor line 1 takes place.

The mail pieces are distributed from the front to the back with descending numbers in another embodiment. The separating knife 2 stands in the center of the stack receiver. Then, the stack from the sorting bin with the highest number placed to its right etc. If the right half of the stack receiver is filled, this stack is then moved to the left. This process can also take place more often with respectively smaller stacks. The aim of this process is to always have the loading location as closely as possible to the bin wall to thereby minimize the distances during the loading of the stack receiver.

Because the maximal filling ratio for the sorting bins can be exceeded in exceptional cases, so-called over-flow bins are provided. These too must be emptied in the right order (if bin no. 4 is assigned to an overflow bin no. 4+, bin no. 4 is emptied first, then bin no. 4+). They are therefore meaningfully and evenly distributed over the sorting plant such that it can always be left from the stack receiver for their emptying. The minimal distance needs to therefore be covered for the emptying of the sorting bins of the stack receiver.

By using of lamp tracers as control mechanism for the emptying order, the operator is guided.

steady light=bin filled flashing light=next bin to be emptied no extinction after acknowledgement=additional overflow bin needs to still be emptied.

After emptying of the entire letter sorting system on the individual stack receivers, the letters are moved, turn-free to the feeder.

The first stack receiver to be emptied is the one with the stack from bin no. 1 to its right end. For the above described version, this would be the stack receiver at the end of the letter sorting system. The respective stack receiver is first docked in extension to the mail conveyor line of the feeder. The moveable stack base 5 and the supporting wall 6 of the stack receiver is moved together with the two separating knives 8, 9 over the empty mail conveyor line 1 to the separating knife 4 of the feeder (its support and guidance occurs thereby by the rollers 10, 13 directly on the mail conveyor line) and a base plate of the chassis. The separating knife 4 of the feeder is then swiveled upwards and inserted again behind the stack of the stack receiver. To secure the position against shifting, the separating knife is held with a clamping piece. After the upward folding of the separating knife 4 of the stack receiver, the stack base 5 can be withdrawn and the mail conveyor line is loaded.

Several scenarios are possible according to the fill level of the mail conveyor line:

Only approximately 20 cm remain in front of the mail singling device at the end of the mail conveyor line. The stack receiver can be unloaded in one process, the mail singling device continues to run.

No remaining stack: the mail singling device stops and the stack receiver is also unloaded at once.

The fill level is greater than the capacity of the mail conveyor line: the mail conveyor line is only reloaded. The remaining stack is prevented from turning over by inserting the separating knife at the respective place.

If the stack receiver is unloaded, the remaining follow in the respective order.

The invention being thus described, it will be obvious that the same may be varied in many ways. The variations are not to be regarded as a departure from the spirit and scope of the invention, and all such modifications as would be obvious to one skilled in the art are intended to be included within the scope of the following claims.

We claim:

1. A device for loading of a feeder of a letter sorting system, comprising:

a mail singling device, a horizontally directed mail conveyor line with a supporting wall for transport of edgewise standing, flat mail pieces to the mail singling device, and a separating knife swiveling in and out of the transport direction for the support and transport of mail pieces to the mail singling device traveling and reversing again along linear guides, wherein at least a stack receiver located on a chassis, picking up the mail stack at any location with a stack base horizontally moveable in stack direction, beyond the chassis, one or two separating knives supporting the stack, moveable along the stack base and swiveling in and out of the stack receiver and an additional supporting wall, whereby the dimensions and the height of the stack receiver are designed in such a way that the stack base is moveable with the separating knife to the stack receiver on the stack conveyor line to the separating knife of the feeder and that in the following, after the separating knife of the feeder has swiveled out, moved and swiveled in again behind the mail stack located on the stack base, and that the separating knives of the stack receiver are swiveled out, the stack base can be withdrawn under the mail pieces from the area of the mail conveyor line and is moveable into the loading position with the separating knives of the stack receiver.

2. The device according to claim 1, wherein the separating knife of the mail conveyor line is moveable by a traveling device, keeping the measured stack pressure at the mail singling device controlled constant in direction to the mail singling device.

3. The device according to claim 2, wherein the mail conveyor line comprises a conveying belt which moves in sync with the swiveled in separating knife if the mail stack is moved to the mail singling device.

4. The device according to claim 1, wherein the stack base of the stack receiver is at least partially designed as conveying belt with a rough surface moving only in direction to the mail singling device.

5. A method for the loading of a feeder of a letter sorting system, comprising the steps of:

loading a stack receiver with a mail stack, the stack supported by one or two separating knives;

advancing the loaded stack receiver to the feeder and extending a stack base of the stack receiver beyond a chassis on the mail conveyor line up to the separating knife of the mail conveyor line and, if necessary, pushing closer the mail stack of the stack receiver to the stack still standing on the mail conveyor line or the mail singling device;

swiveling out of separating knife of the mail conveyor line, reversing closely behind the rear separating knife in direction to the mail singling device and supporting the mail stack standing on the stack base and swiveling into the mail conveyor line;

swiveling out the one or two separating knives of the stack receiver, run-in of the stack-base into the area of the chassis, advancing the chassis to the loading location, and loading with an additional mail stack.

6. The method according to claim 5, wherein the stack receiver is advanced to the sorting bins of any letter sorting system and loaded from the sorting bins.

7. The method according to claim 6, wherein the stack receiver is advanced to the sorting bins of the letter sorting system for a sorting process with several sorting runs and loaded, which feeder needs to be loaded with the assistance of the stack receiver several times.

* * * * *